US010351216B2

(12) United States Patent
Isom

(10) Patent No.: US 10,351,216 B2
(45) Date of Patent: Jul. 16, 2019

(54) STANDING TORSO SUPPORT APPARATUS FOR PADDLEBOARDS

(71) Applicant: John Isom, St. George, UT (US)

(72) Inventor: John Isom, St. George, UT (US)

( * ) Notice: Subject to any disclaimer, the term of this patent is extended or adjusted under 35 U.S.C. 154(b) by 0 days.

(21) Appl. No.: 15/697,683

(22) Filed: Sep. 7, 2017

(65) Prior Publication Data

US 2018/0065718 A1 Mar. 8, 2018

Related U.S. Application Data

(60) Provisional application No. 62/384,329, filed on Sep. 7, 2016.

(51) Int. Cl.

| | |
|---|---|
| ***B63B 1/00*** | (2006.01) |
| ***B63B 35/00*** | (2006.01) |
| ***B63B 35/79*** | (2006.01) |
| ***B63B 35/85*** | (2006.01) |

(52) U.S. Cl.

CPC ..... *B63B 35/7933* (2013.01); *B63B 35/85* (2013.01)

(58) Field of Classification Search

CPC . B63B 35/79; B63B 35/7933; B63B 2035/79; B63B 2035/7933

USPC ..... 441/74, 79

See application file for complete search history.

(56) References Cited

U.S. PATENT DOCUMENTS

| | | | | |
|---|---|---|---|---|
| 9,199,702 | B2 * | 12/2015 | Cregier | B63B 35/71 |
| 9,428,253 | B1 * | 8/2016 | Morgan | B63B 35/7933 |
| 9,643,696 | B1 * | 5/2017 | Lockhart | B63B 35/85 |
| 2012/0077396 | A1 * | 3/2012 | Lipman | B63B 35/71 441/74 |

* cited by examiner

*Primary Examiner* — Daniel V Venne

(74) *Attorney, Agent, or Firm* — Gurr Brande & Spendlove, PLLC; Robert A. Gurr

(57) ABSTRACT

A standing torso support apparatus for paddleboards has a base removably attachable to a paddleboard, an adjustable-height support leg extending upward from the base, and a torso support attached to the top of the support leg. A user may lean against the torso support to aid in balance or power.

2 Claims, 6 Drawing Sheets

STANDING TORSO SUPPORT APPARATUS FOR PADDLEBOARDS

CROSS-REFERENCE TO RELATED APPLICATIONS

This application claims the benefit of U.S. Provisional Application Ser. No. 62/384,329, filed on Sep. 7, 2016, which is incorporated herein by reference in its entirety.

TECHNICAL FIELD

The present disclosure relates to watersports. More specifically, the present disclosure relates to a standing torso support for use on a paddleboard.

BACKGROUND

Paddleboarding has been rising in popularity for many years. As used herein, paddleboarding refers to a user standing on a board (e.g., paddleboard or surfboard) while paddling on the water. When first learning to paddleboard, it can be difficult to maintain balance and not fall into the water. Keeping your balance stable is a process that takes time and practice. Because of this, users often get frustrated by their inability to quickly learn to paddleboard. Further, users often tire quickly when learning to paddleboard, as they must frequently get back on the board after falling into the water. The prior art has failed to address this problem.

Further, experienced paddleboarders lack additional leverage that is often required to power through strong waves, currents, or long distances. As such, there is a need for additional leverage on a paddleboard.

Accordingly, the present invention seeks to solve these and other problems.

SUMMARY OF EXAMPLE EMBODIMENTS

The present disclosure is directed to a standing torso support apparatus for paddleboards. In one embodiment, the apparatus comprises a base removably attachable to a paddleboard (or other board for use on the water, such as a surf board), an adjustable-height support leg extending upward from the base, and a torso support attached to the top of the support leg.

In one embodiment, a standing torso support apparatus comprises a paddleboard having a receptacle for receiving a support leg, the support leg being height-adjustable and further comprising a torso support coupled thereto.

DETAILED DESCRIPTION OF EXAMPLE EMBODIMENTS

Figure 1:
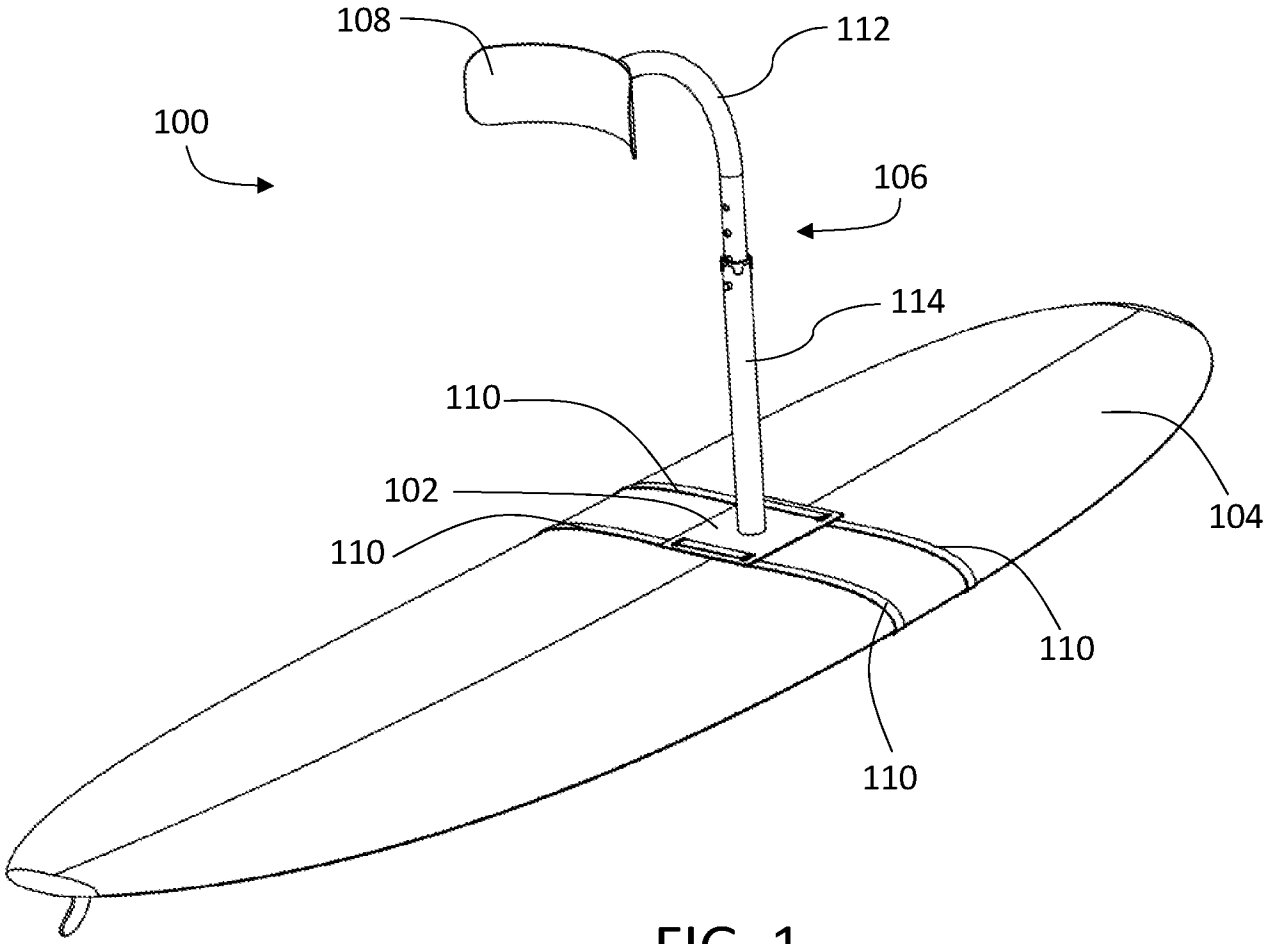
FIG. 1 is a rear perspective view of a standing torso support apparatus on a paddleboard.

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

Further, while the examples generally refer to the use of paddleboards, it will be appreciated that other boards may also be used, such as surf boards and the like. Further, while described in combination with watersports, the present invention may also be used in other sports where a board is used that requires balance, such as snowboarding, longboarding, etc.

As disclosed herein, a standing torso support apparatus for paddleboards allows a novice user, or the ill-balanced, to maintain a standing position on a paddleboard. Further, the standing torso support apparatus allows experienced users to achieve a greater amount of force, allowing for faster, more controlled paddling and support.

Figure 2:
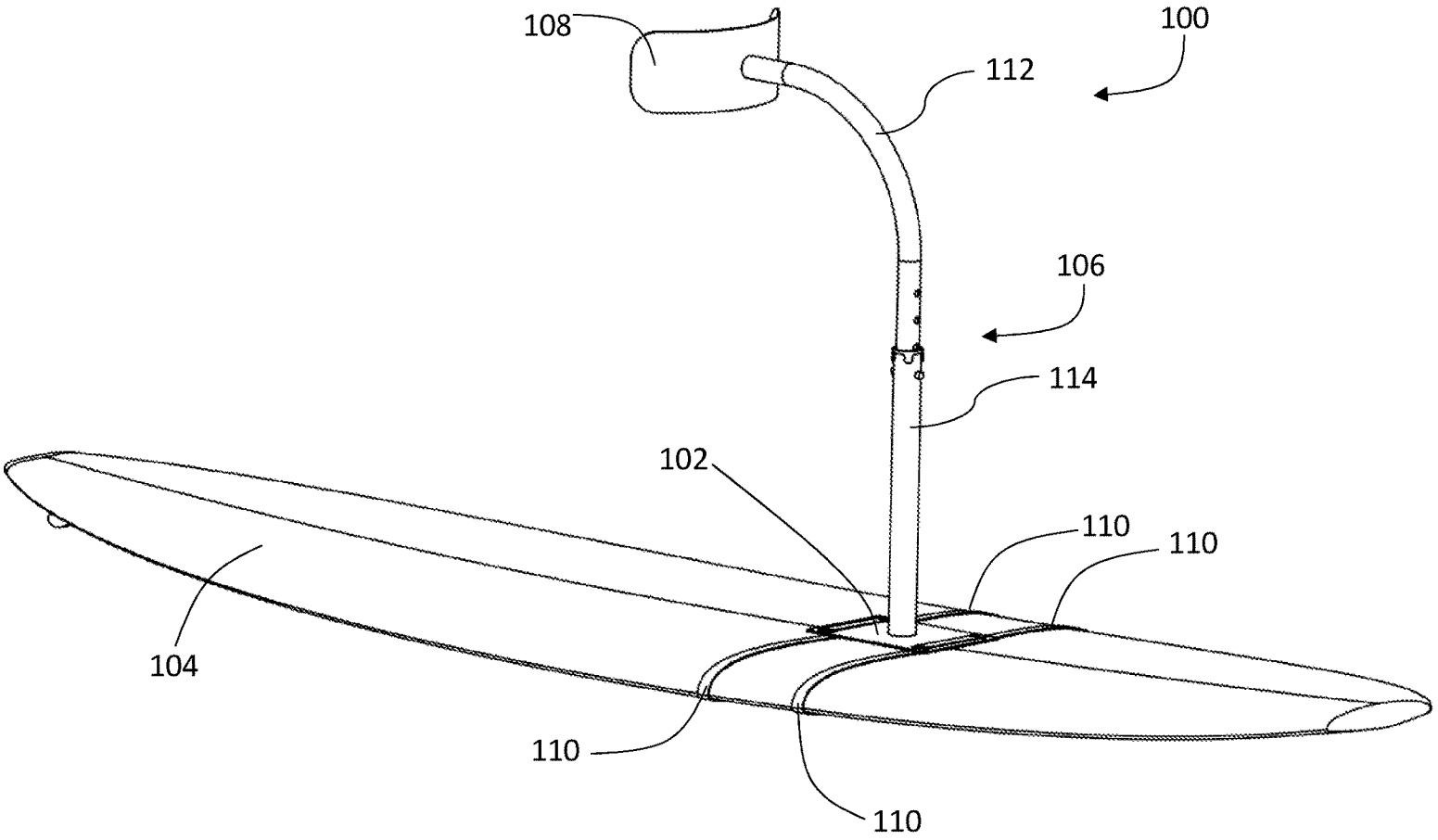
FIG. 2 is a front perspective view of a standing torso support apparatus on a paddleboard.
Figure 4:
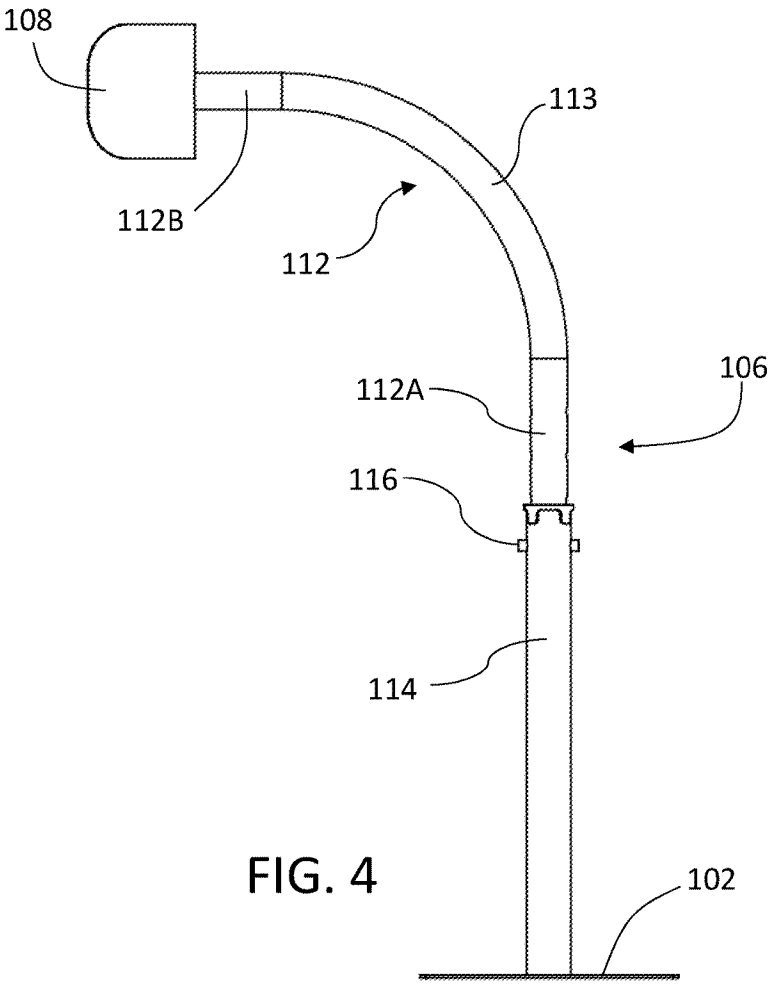
FIG. 4 is a side elevation view of a standing torso support apparatus.
Figure 3:
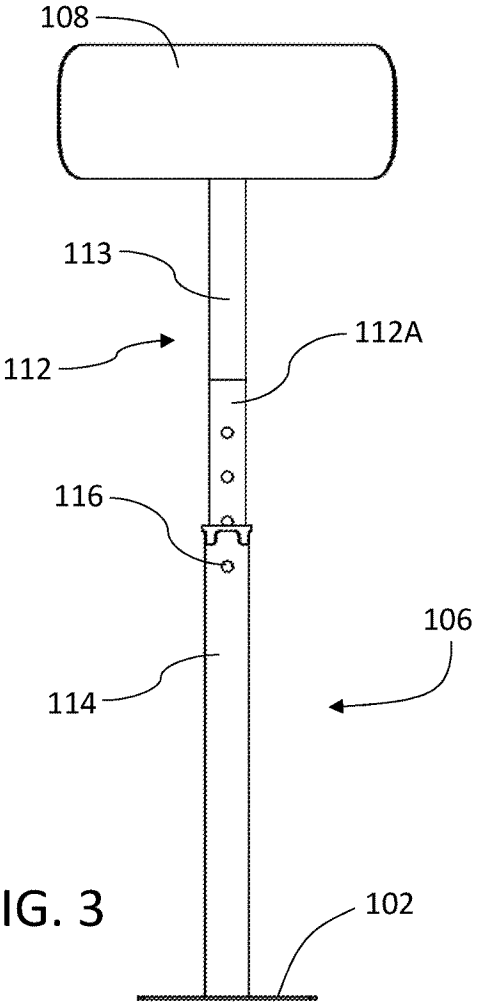
FIG. 3 is a rear elevation view of a standing torso support apparatus.
Figure 5:
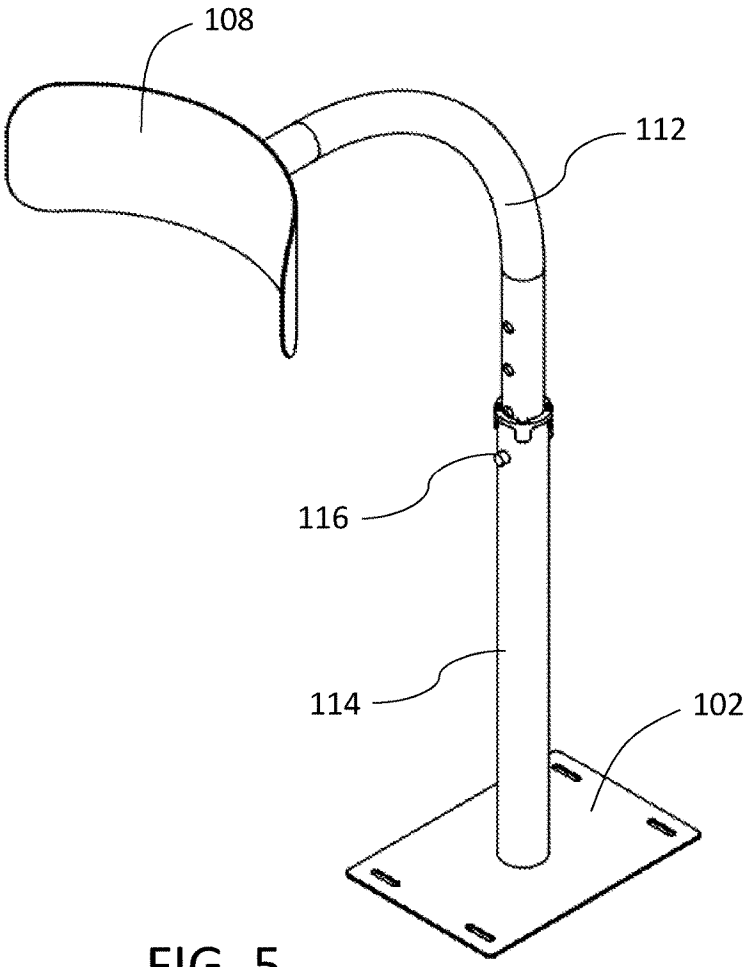
FIG. 5 is a side elevation view of a standing torso support apparatus.

Referring now to what is generally illustrated in FIGS. 1-6, a standing torso support apparatus 100 comprises a base 102 removably attachable to a paddleboard 104 (or other board, such as a surfboard or snowboard), an adjustable-height support leg 106 extending upward from the base 102, and a torso support 108 coupled to the top of the support leg 106. As shown in FIGS. 1-2, in one embodiment, the base 102 is coupled to the paddleboard 104 using straps 110. The straps 110 may be secured using any number of securing mechanisms known in the art, such as hooks and loops (e.g., Velcro®), snaps, buckles, loops, etc. The straps 110 may pass through one or more apertures in the base 102 to keep the base 102 secured to the board 104. Support leg 106 may be telescopic in nature, comprising a male member 112 and a receiving female member 114. The male member 112 may be secured to receiving female member 114 using spring-loaded pins 116, cotter pins, twist and lock mechanisms, or similar means commonly known and used on telescoping legs. The support leg 106 may further comprise a sleeve or other spacer disposed between the male member 112 and female member 114 so as to reduce wear and friction on the two components. Referring to FIGS. 3-4, male member 112 may comprise an elbow bend, 113 wherein a first portion 112A of the male member 112 is perpendicular to the paddleboard 104 and a second portion 112B of the male member 112 is parallel to the paddleboard 104, so that the torso support 108 is projected toward a user for engaging a user's abdomen/hip area. In an alternate embodiment, not shown, the male member is straight with the torso support being mounted on the side thereof. The base 102 may be manufactured from a variety of materials, such as wood, plastic, carbon fiber, fiberglass, etc. Further, the base 102 may comprise additional components (e.g., spacers) so as to protect the paddleboard 104 from damage, such as rubber or felt pads, or similar means that would be interposed between the base 102 and the paddleboard 104. The support leg 106 may likewise be manufactured from materials that are rigid and strong enough to support a user leaning thereon. Ideally, the materials used are resistant to corrosion. Torso support 108 may be contoured to at least partially wrap-around a user's torso/hips, as shown in the Figures, or may simply be straight for a user to lean against. Further, torso support 108 may comprise cushions and/or covers to make it more comfortable for a user during use. While the use of seats on paddleboards is known in the prior art, a torso support 108 is not known in the prior art. Unlike seats in the art, the torso support 108 teaches a user to balance on their feet, and also provides experienced users with the ability to paddle harder (additional thrust to the paddles), using the torso support 108 to counteract the force applied to the paddles. The seats in the prior art fail to accomplish these ends.

As a non-limiting example of use, a user would strap the base 102 to the board 104 using straps 110. The user would then adjust the height of the torso support 108 using telescoping support leg 106. The user may then stand against, or lean against, the torso support 108 while using the board (e.g., paddleboard in water or snowboard on snow), aiding in stability and power.

Figure 6:
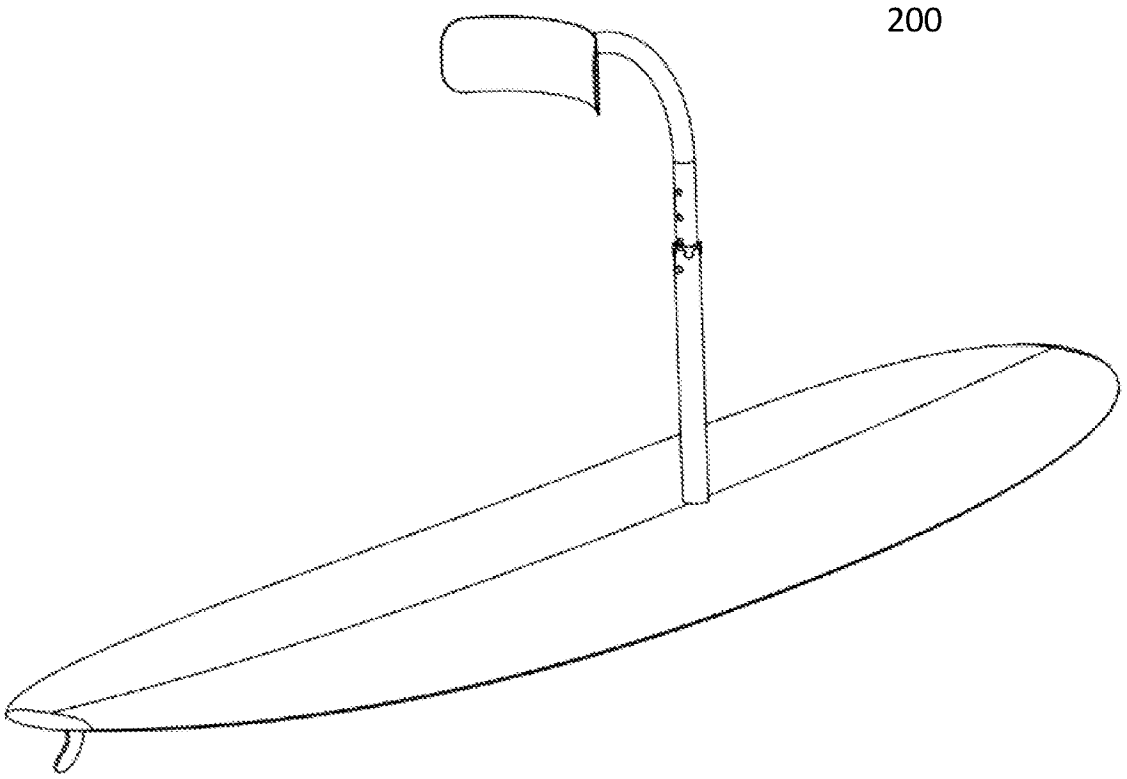
FIG. 6 is a rear perspective view of a standing torso support apparatus on a paddleboard.

Referring now to FIG. 6, in one embodiment, a standing torso support apparatus 200 comprises a paddleboard 202 having a receptacle (not visible) embedded therein for receiving a support leg 204, the support leg 204 being height-adjustable (e.g., telescopic) and further comprising a torso support 206 coupled thereto. For example, paddleboard 202 may have a receptacle manufactured therein, so that a user need not attach a base thereto. The receptacle may be threaded, with the support leg 204 having a complementary threaded end for being threadably coupled to the paddleboard 202. When not in use, the receptacle may have a cover (e.g., snap on or threaded). Accordingly, a user desiring to use the support leg 204 would remove the cover (unscrew if threaded, pop-off, etc.), exposing the receptacle (a female receiver). The bottom of the support leg 204 is then inserted into the receptacle. While threads are described, the support leg 204 may be secured to the receptacle using a variety of mechanisms, such as a twist and lock mechanism (e.g., a protrusion on the male portion that slides vertically into a receiving channel within the female receiver until fully-seated, wherein the channel continues at a 90° angle therefrom, allowing a user to twist the support leg 204, thereby restricting vertical removal), bolts, cotter pins, or any other suitable mechanism.

Figure 7:
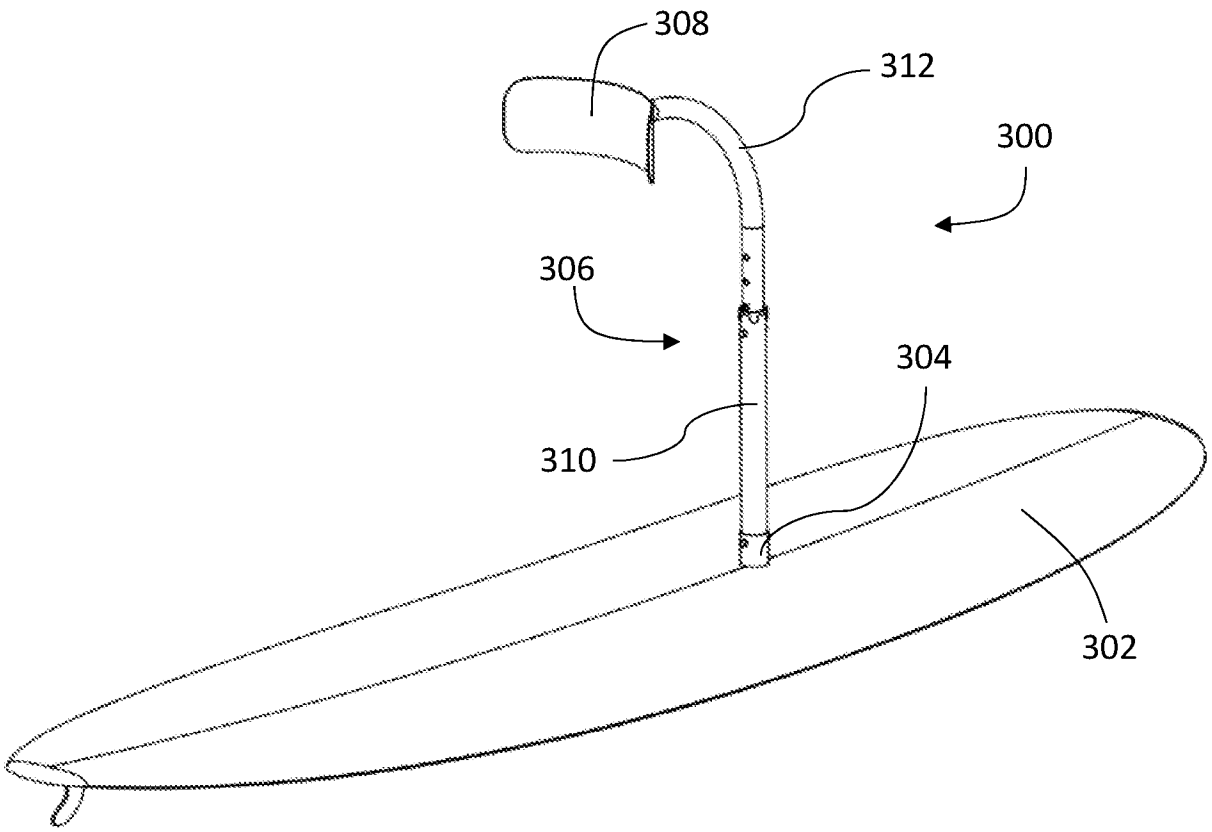
FIG. 7 is a rear perspective view of a standing torso support apparatus on a paddleboard.

FIG. 7 illustrates a standing torso support apparatus 300 comprising a paddleboard 302, a receiving bracket 304, a height-adjustable support leg 306, and a torso support 308. The bracket 304 may be coupled to the paddleboard 302 in a number of ways, including bolts, screws, adhesives, being threaded or otherwise inserted at least partially into the board (i.e., the board may have a hole drilled therein for receiving the bracket 304), or any other suitable method. A first end of female member 310 is then inserted in the bracket 304 and is secured thereto, such as by using threads, twist-and-lock mechanisms, cotter pins, or similar. The second end of female member 310 receives male member 312, which may be straight, or bent as illustrated in FIG. 7. The torso support 308 is preferably about perpendicular to the board 302, so that it engages a user's abdomen or torso.

As appreciated from the foregoing, there are several methods of coupling a standing torso support to a board. Additional methods of coupling the standing torso support to a board, while not explicitly discussed, are contemplated herein and fall within the scope of this invention.

The use of a standing torso support, as described herein, allows a user to rest his or her torso against the torso support, aiding in balance and leverage. With a standard paddleboard, as a user pushes a paddle rearward, the body compensates by moving forward, thereby limiting power. In contrast, when a user utilizes a standing torso support apparatus as described above, the torso rests against the torso support, allowing the user to push the paddle rearward with more power. Further, the standing torso support apparatus helps novice users, and those with balance issues, to maintain balance on the board.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A standing torso support apparatus, comprising:

a paddleboard having an embedded female receiver for receiving a support leg;

the support leg comprising:

a female member and a male member;

the female member perpendicular to the paddleboard;

the male member slidable in relation to the female member so as to be height-adjustable;

the male member being securable to the female member via a spring-loaded pin; and the male member comprising an elbow bend wherein a first portion of the male member is perpendicular to the paddleboard and a second portion of the male member is parallel to the paddleboard;

and a contoured torso support coupled to the second portion of the male member, the contoured torso support engaging an abdomen of a user.

2. A method of using a standing torso support apparatus, comprising:

securing a support leg to a paddleboard, the support leg comprising a female member and a male member, the female member perpendicular to the paddleboard; the male member slidable in relation to the female member so as to be being height-adjustable; the male member comprising an elbow bend wherein a first portion of the male member is perpendicular to the paddleboard and a second portion of the male member is parallel to the paddleboard; and, a contoured torso support coupled to the second portion of the male member; and a user leaning their abdomen against the contoured torso support while using the paddleboard.

* * * * *